US008508147B2

(12) United States Patent
Shen

(10) Patent No.: US 8,508,147 B2
(45) Date of Patent: Aug. 13, 2013

(54) DIMMER CIRCUIT APPLICABLE FOR LED DEVICE AND CONTROL METHOD THEREOF

(75) Inventor: Feng-Min Shen, Hsinchu County (TW)

(73) Assignee: United Power Research Technology Corp., Zhunan Township, Miaoli County (TW)

( * ) Notice: Subject to any disclaimer, the term of this patent is extended or adjusted under 35 U.S.C. 154(b) by 288 days.

(21) Appl. No.: 13/095,260

(22) Filed: Apr. 27, 2011

(65) Prior Publication Data

US 2011/0291583 A1 Dec. 1, 2011

(30) Foreign Application Priority Data

Jun. 1, 2010 (TW) ..... 99117507 A
Dec. 28, 2010 (TW) ..... 99146213 A

(51) Int. Cl.
*H05B 41/16* (2006.01)

(52) U.S. Cl.
USPC ..... 315/287; 315/200 R; 315/307

(58) Field of Classification Search
USPC ..... 315/200 R, 210, 224, 287, 291, 293, 315/307–309
See application file for complete search history.

(56) References Cited

U.S. PATENT DOCUMENTS

2011/0057564 A1* 3/2011 Otake ..... 315/51
2011/0068706 A1* 3/2011 Otake et al. ..... 315/291
2012/0056553 A1* 3/2012 Koolen et al. ..... 315/291
2012/0242238 A1* 9/2012 Chen et al. ..... 315/200 R
2012/0274216 A1* 11/2012 Datta ..... 315/127
2012/0319610 A1* 12/2012 Yoshinaga ..... 315/210
2013/0057169 A1* 3/2013 Harel ..... 315/200 R

* cited by examiner

*Primary Examiner* — Don Le
(74) *Attorney, Agent, or Firm* — Muncy, Geissler, Olds & Lowe, PLLC

(57) ABSTRACT

A dimmer circuit applicable for LED device and control method thereof is disclosed in the embodiments of the present invention. The dimmer circuit is applicable for controlling at least a LED device. The dimmer circuit includes a rectifier, a bleeder, a phase angle detect circuit, a constant current circuit and a programmable micro controller. The phase angle detect circuit couples to the programmable micro controller. The constant current circuit couples to the LED device The programmable micro controller generates a PWM signal according to the output signal of the phase angle detect circuit to adjust current of the constant current circuit.

15 Claims, 4 Drawing Sheets

DIMMER CIRCUIT APPLICABLE FOR LED DEVICE AND CONTROL METHOD THEREOF

BACKGROUND OF THE INVENTION

This application claims the benefit of the filing date of Taiwan Application Ser. No. 099117507, filed on Jun. 1, 2010 and No. 099146213, filed on Dec. 28, 2010, the contents of which are incorporated herein by reference.

(a) Field of the Invention

The invention relates to a dimmer circuit and a control method.

(b) Description of the Related Art

A conventional TRIAC (Triode for alternating current) dimmer is used to control an incandescent lamp. The TRIAC dimmer outputs an output signal to the incandescent lamp. Further the TRIAC dimmer adjusts phases of the output signal to change the signal output power so as to adjust the luminance of the incandescent lamp. A TRIAC is triggered by a conducting current (latch current $I_{latch}$), and is maintained in a conducting state by a holding current $I_{hold}$. Thus a TRIAC should work between the latch current $I_{latch}$ and the holding current $I_{hold}$ for keeping a steady state.

Since a TRIAC works at the the latch current $I_{latch}$ and the holding current $I_{hold}$, a circuit designed with a TRIAC should couple to a linear load for generating the current $I_{latch}$ and $I_{hold}$. The incandescent lamp is a linear load so that the TRIAC dimmer may generate the current $I_{latch}$ and $I_{hold}$ with the incandescent lamp. Thus the TRIAC dimmer may function steadily with the incandescent lamp.

Furthermore a LED (light emitting diode) device is not a linear load. The TRIAC dimmer cannot directly drive a LED device to generate the current $I_{latch}$ and $I_{hold}$. Some external device should be used to generate the $I_{latch}$ and $I_{hold}$ currents.

Generally, a LED device may be driven by the TRIAC dimmer with other external circuits, such as a bleeder. The bleeder may be a linear load for the TRIAC dimmer. However, driving a LED device with the bleeder may cause the following problems:

a. decreasing power usage efficiency and increasing power consumption of circuit;

b. requiring the setting of the $I_{latch}$ and $I_{hold}$ currents to conform to the characteristic of different TRIAC dimmers;

c. using a linear load to provide $I_{latch}$ and $I_{hold}$ to result in temperature increase of the system; and d. complicate dynamic load circuit design to increase system cost.

Different TRIAC dimmers may be designed with different gate control circuits so as to cause different conduction angles within signals. Further the different conduction angles within signals outputted by the TRIAC dimmer may lead to different output power. Therefore, the design for a LED control circuit has the following problems:

a. different conduction angles between positive and negative conduction angle within an output signal of a TRIAC;

b. different initial conduction angles for a different TRIAC dimmers;

c. difficulty in the linearization of the gate control circuit to cause the difficulty in synchronously dimming the LED control circuit;

d. difficulty in programming a dimming curve for a LED device;

e. abnormal flickering light from a LED device due to a mismatch between characteristic of the TRIAC dimmer and the control circuit of a LED.

BRIEF SUMMARY OF THE INVENTION

The above-mentioned problems may happen while a TRIAC (triode for alternating current) dimming circuit is in use. The present invention is not only to solve the problems while using a TRIAC but also to adjust a power output switch element by adjusting phases, which is also in the scope of the present invention.

One object of the invention is to use a programmable micro controller and use software to change the operation method of the micro controller. The commercially available bleeder and/or phase detect circuit and/or LED current control circuit may be used to cooperate with the micro controller to achieve the purpose of brightness adjustment of a LED element.

One object of the invention is to use a micro controller with a burn-in program accompanying with the commercially available bleeder and/or phase detect circuit and/or LED current control circuit to achieve the purpose of brightness adjustment of a LED element.

One object of the invention is to use a preset micro controller to control a preset bleeder and/or a preset phase detect circuit and/or a preset LED current control circuit to achieve the purpose of brightness adjustment of a LED element.

One object of the invention is to use a dimmer circuit to adjust brightness of a LED element according to user's needs.

One object of the invention is to use a frequency modulation control method to control a preset bleeder to improve the efficiency of the current bleeder.

One object of the invention is to use a synchronous phase detecting method cooperating with a bleeder to control a preset phase detect circuit to acquire the phase angle of a dimmer.

One embodiment of the invention provides an effective dimmer circuit and a control method thereof. The dimmer circuit includes a bleeder control framework, a phase angle detecting method of a TRIAC dimmer, a phase angle filter, a dimming curve translator, a pulse width modulation circuit and so forth.

The operating principle of the dimmer circuit and control method according to an embodiment of the invention is described as follows. The micro controller generates a driving signal to a bleeder and then a phase angle detect circuit acquires a phase angle. Then, a phase angle filter and a dimming curve translator in the micro controller calculate an output parameter. The PWM (pulse width modulation) circuit receives the output parameter and outputs a modulation signal to a LED current control circuit. Finally, the brightness of a LED device is adjusted according to the modulation signal.

An embodiment of the invention provides a dimmer circuit. The dimmer circuit includes a bleeder as a dummy load; a phase dimmer for generating a signal corresponding to an adjustment of the phase dimmer by a user; a phase detect circuit for detecting a phase angle of the signal; a pulse width modulation (PWM) circuit for generating a PWM signal to drive a light emitting diode (LED) device; and a programmable micro controller, coupled to the phase detect circuit, wherein the programmable micro controller receives the signal and the phase angle to determine pulse width of the PWM signal according to the phase angle and the programmable micro controller generates a control signal to turn on/off the bleeder according to the phase angle.

An embodiment of the invention provides a programmable micro controller. The programmable micro controller includes a phase angle detect circuit, for detecting a phase angle of a signal provided by a phase detect circuit; a phase angle filter for filtering noises of the phase angle; a driver for generating a driving signal according to a command to control a bleeder; a timer for generating a clock synchronous with the driver and the phase angle detect circuit; a dimming curve translator for providing a dimming curve; a pulse width modulation circuit, for generating a PWM signal to control brightness of the LED device; and a control logic for operating in coordination with the clock of the timer, receiving the phase angle, and determining the command to control the driver and the pulse width modulation circuit to generate the pulse width modulation signal, according to the phase angle.

An embodiment of the invention provides a frequency modulation method for controlling a bleeder, comprising the following steps: providing a tick timer and using a phase angle signal from a phase detect circuit to determine whether or not to increase or decrease tick timer and to compare if overflow occurs, wherein the bleeder is triggered when overflow occurs; correlating the phase angle to a conversion curve and performing calculation to generate a corresponding pulse width modulation duty cycle to control brightness of a light emitting diode device; and determining whether a current phase angle is larger than a previous phase angle or not, decreasing the tick timer when the current phase angle is larger than the previous phase angle, and increasing the tick timer when the current phase angle is smaller than the previous phase angle.

An embodiment of the invention provides a method for a programmable micro controller to detect a phase angle, comprising the following steps: determining whether an operating clock of phase angle detection is synchronous with a trigger signal of a bleeder or not and acquiring the phase angle when it is synchronous; determining whether a current phase angle is a new phase angle or not and filtering the new phase angle if the current phase angle is a phase angle; determining whether the received phase angle is changed or not; if the received phase angle is changed, performs phase angle/brightness conversion according to information related to the changed phase angle and provides the result to generate a corresponding PWM signal to control brightness of a light emitting diode device.

DETAILED DESCRIPTION OF THE INVENTION

The following embodiments uses a TRIAC (triode for alternating current) dimmer circuit as examples to illustrate the present invention. It should be noted that the present invention is not limited to the TRIAC. The present invention may applicable to current or future switch elements. Those who are skilled in the art may modify the technique of the present invention which is still within the scope of the present invention.

Figure 1:
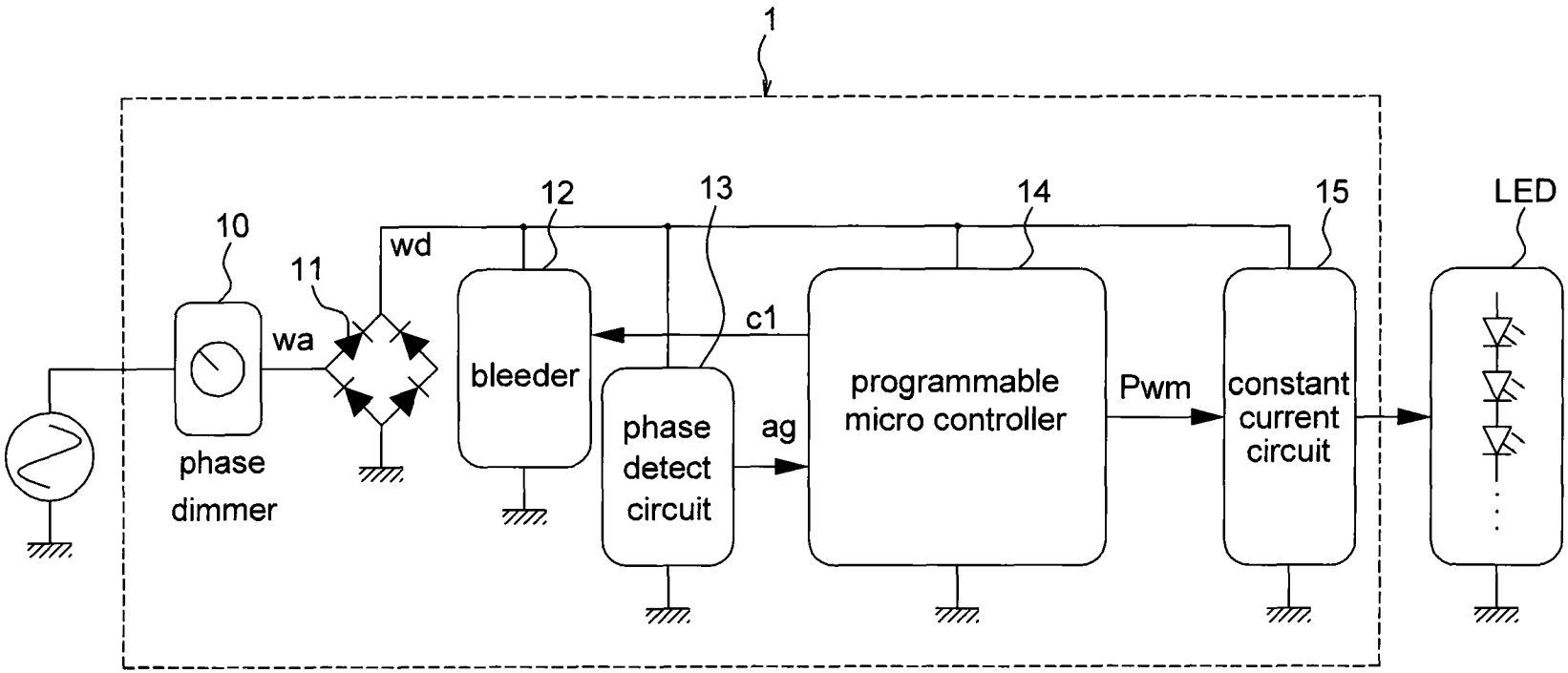
FIG. 1 shows a schematic diagram illustrating a dimmer circuit according to an embodiment of the invention.

FIG. 1 is a schematic diagram illustrating an embodiment of a dimmer circuit. The dimmer circuit 1 is applicable to a light emitting diode (LED) device. The dimmer circuit 1 includes a phase dimmer 10, a rectifier 11, a bleeder 12, a phase detect circuit 13, a programmable micro controller 14 and a constant current circuit 15. In an embodiment, the constant current circuit 15 may be optional.

The phase dimmer 10 generates an AC signal wa corresponding to an adjustment by a user. The rectifier 11 rectifies the AC signal to generate a DC signal wd. The bleeder 12, coupled to the rectifier 11, is used as a dummy load. The phase detect circuit 13, coupled to the bleeder 12, detects a phase angle ag of the DC signal wd to thereby output a phase angle ag of the DC signal wd.

The programmable micro controller 14, coupled to the phase detect circuit 13, receives the DC signal wd and the phase angle ag and determines a pulse width modulation (PWM) signal Pwm according to the phase angle ag. The programmable micro controller 14 generates a control signal c1 to turn on the bleeder 12 to consume the load so that the dimmer can steadily output the AC signal wa. After acquiring the phase angle ag, the programmable micro controller 14 turns off the bleeder 12.

In an embodiment, if the phase angle ag of the DC signal wd is constant, the pulse width of the PWM signal Pwm remains the same. Further, the constant current circuit 15 receives the PWM output signal Pwm to generate a constant current to maintain the brightness of the LED device.

In an embodiment, if the phase angle ag is changed, the programmable micro controller 14 generates a control signal c1 to turn on the bleeder 12 to consume the load. Thus the dimmer can steadily output the AC signal wa. After acquiring the phase angle ag, the programmable micro controller 14 generates a control signal c1 to turn off the bleeder 12. The programmable micro controller 14 adjusts the pulse width of the PWM signal Pwm according to the variation of the phase angle ag of the DC signal wd to let the adjustment of pulse width corresponds to the variation of the phase angle. Then, the constant current circuit 15 adjusts its output current according to the adjusted PWM signal so as to change the brightness of the LED device. It should be noted that, after the brightness is changed, if the phase angle ag stays the same, the constant current circuit 15 maintains the brightness at the same level.

Figure 2:
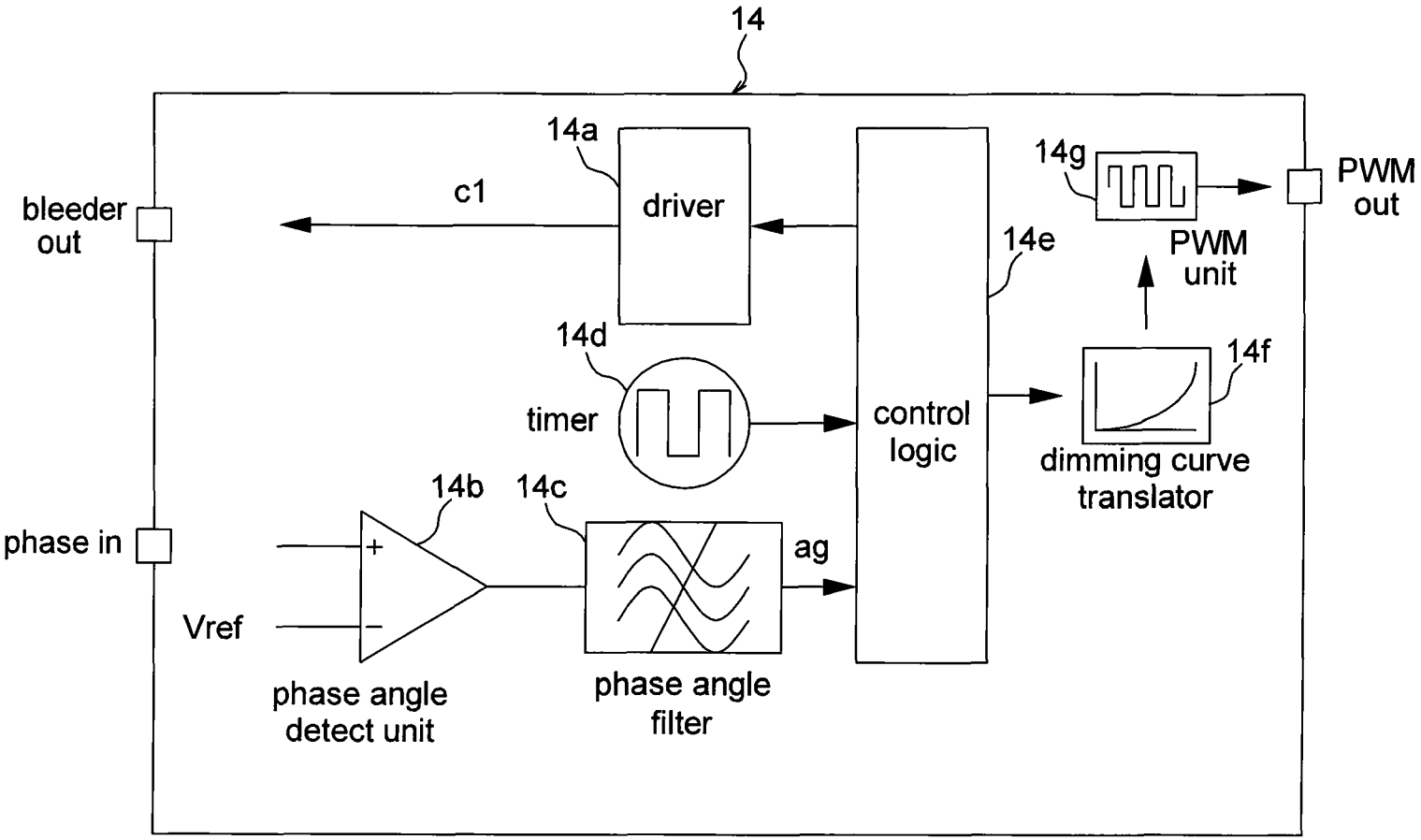
FIG. 2 shows a functional block diagram illustrating internal control of a dimmer circuit according to an embodiment of the invention.

FIG. 2 is a function block diagram illustrating an embodiment of a programmable micro controller 14. The programmable micro controller 14 is applicable to the LED device. As shown in FIG. 2, the programmable micro controller 14 includes a driver 14*a*, a phase angle detect unit 14*b*, a phase angle filter 14*c*, a timer 14*d*, a control logic 14*e*, a dimming curve translator 14*f*, and a pulse width modulation (PWM) unit 14*g*.

In an embodiment, the phase angle filter 14*c* is used for filtering the phase angle to prevent the phase angle from noises caused by phase dimmer being unstable, operating temperature effect and power interferences.

The control logic 14*e* operates in relation to the clock of the timer 14*d*. The clock of the timer 14*d* is synchronous with the driver 14*a* and the phase angle detect unit 14*b*. The phase angle detect unit 14*b* receives a phase input signal. The phase angle filter 14*c* filters noises to thereby output a phase angle ag. Then, the control logic 14*e* receives the phase angle ag and determines at least two signals according to the phase angle ag. The control logic 14*e* outputs a first control signal to drive the driver 14*a* and a second control signal to the dimming curve translator 14*f*.

Referring to FIGS. 1 and 2, in an embodiment, the control logic 14*e* outputs the first control signal to drive the driver 14*a* to determine an operating frequency of the bleeder 12 according to a conduction angle of a current phase angle detected by the phase angle detect unit 14*b*.

The dimming curve translator 14*f* generates an adjustment signal according to the second control signal. In an embodiment, the dimming curve translator 14*f* can solve the problems of nonlinearity of the dimming curve, steep curve variation and dissatisfaction for human eyes outputted by different phase dimmers. The dimming curve translator 14*f* is designed by arithmetic program. The dimming curve translator 14*f* can operate with different dimming curves by a weighting calculation method via arithmetic programming, an equal proportion calculation method or a look-up table. Please note that using a hardware circuits is hard to implement various different dimming curves. Thus, the embodiment of the dimming curve translator 14*f* designed by arithmetic program can conveniently satisfy the implementation of the various different dimming curves.

The PWM unit 14*g* generates a PWM signal to drive the LED device according to the adjustment signal from the dimming curve translator 14*f*, thereby changing the brightness of the LED device accordingly. The framework of the PWM unit 14*g* is to perform precise LED power output control to let the constant current circuit 15 adjust brightness according to the phase angle.

The above mentioned operation is to acquire the value of the phase angle via the phase angle detect unit 14*b* and then to acquire the correct dimming value through the phase angle filter 14*c*. Then, the dimming curve translator 14*f* can calculate the output duty cycle of the PWM to generate the adjustment signal according to the dimming curve set by a designer.

Figure 3:
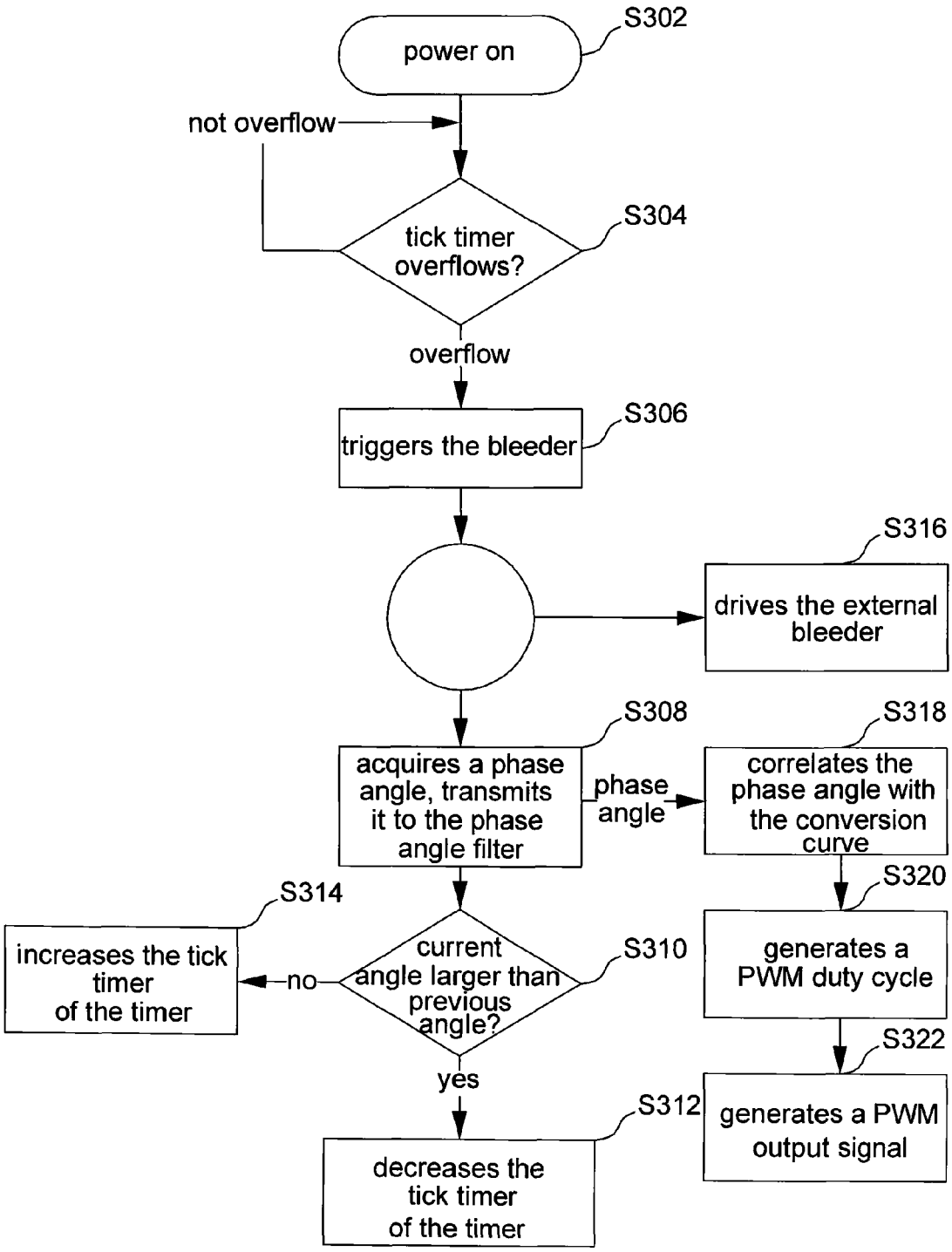
FIG. 3 shows a flow chart illustrating a bleeder and PWM control method according to an embodiment of the invention.

Referring to FIGS. 2 and 3, an embodiment of the operation method of controlling the bleeder 12 by the programmable micro controller 14 is to be described. FIG. 3 shows a flow chart illustrating an example of a bleeder and PWM control method. Specifically, FIG. 3 is a flow chart illustrating the technique of frequency modulation control of the bleeder 12 controlled by the programmable micro controller 14.

Step S302: power is turned on.

Step S304: the control logic 14*e* receives a tick timer from the timer 14*d*; when the tick timer indicates overflow, the timer 14*d* generates an interrupt signal to the control logic 14*e*, goes to step S306; otherwise, determining if the tick timer indicates overflow or not.

Step S306: the programmable micro controller 14 triggers the bleeder 12 and goes to step S316 and S308.

Step S308: the phase angle detect unit 14*b* acquires a phase angle ag, transmits the phase angle ag to the phase angle filter 14*c* and then goes to step S310 and S318.

Step S310: the programmable micro controller 14 determines whether the current phase angle ag is larger than the previous phase angle; if yes, go to step S312, if not, go to step S314.

Step S312: the programmable micro controller 14 decreases the tick timer of the timer 14*d*.

Step S314: the programmable micro controller 14 increases the tick timer of the timer 14*d*.

Step S316: the programmable micro controller 14 controls the driver 14*a* to drive the external bleeder 12. In one embodiment, according to the requirement from a designer, the bleeder 12 may be disposed in the programmable micro controller 14.

Step S318: the programmable micro controller 14 correlates the phase angle ag with the conversion curve provided by the dimming curve translator 14*f*. Further the dimming curve translator 14*f* generates a calculation result to the PWM unit 14*g*. In one embodiment, the programmable micro controller 14 transmits the information related to the signal status such as the phase angle ag . . . , etc. to the dimming curve translator 14*f*. The dimming curve translator 14*f* converts the phase angle ag according to the dimming curve to generate the calculation result to the PWM unit 14*g*. It should be noted that the dimming curve is according to the needs of a designer.

Step S320: the PWM unit 14*g* generates a PWM duty cycle according to the calculation result.

Step S322: the PWM unit 14*g* generates a PWM signal Pwm to control the brightness of the LED device.

Please note that if the phase angle ag has a smaller conduction angle, the programmable micro controller 14 controls the bleeder 12 having a higher operation frequency. On the contrary, if the phase angle ag has a larger conduction angle, the programmable micro controller 14 controls the bleeder 12 to have a lower operation frequency.

In one embodiment of the step S316, as the conduction angle of the DC signal wd received by the bleeder 12 is small, the input power of the phase dimmer 10 is small and power consumption is small. Since the conduction angle is small, the operating frequency of the bleeder 12 is high to thereby let the system of the dimmer circuit 1 be under a stable operating state. Therefore, the response speed of the dimmer circuit 1 is increased. On the contrary, if the conduction angle becomes larger, the operating frequency of the bleeder 12 becomes lower. Since the input power of the phase dimmer 10 is high enough, the dimmer circuit 1 functions steadily and there is no excessive power consumption on the bleeder 12. Thus the programmable micro controller 14 uses different conduction angles of the phase angle to determine the operating frequency of the bleeder 12 to effectively let the phase dimmer 10 function properly. Since the dimmer circuit 1 can adjust the operation frequency of the bleeder 12, the magnitude of a dummy load formed by the bleeder 12 can be adjusted. Thus, the power consumption of load can be controlled. The power consumption problem of a general linear load in the prior art can be solved.

Figure 4:
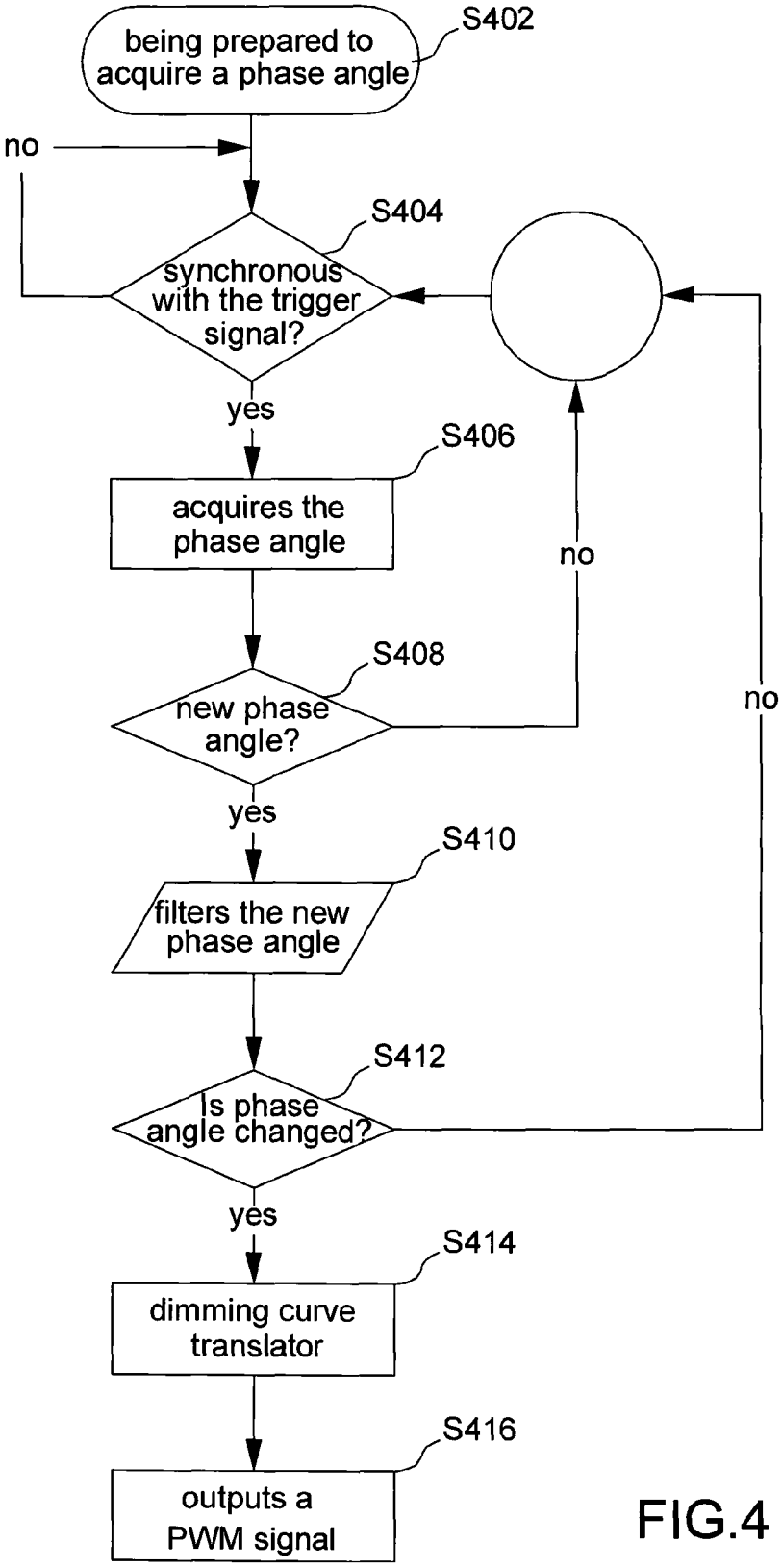
FIG. 4 shows a flow chart illustrating a phase acquisition control method according to another embodiment of the invention.

FIG. 4 shows a flow chart illustrating an embodiment of a phase acquisition control method. Specifically, FIG. 4 is an embodiment of a detection mechanism flow chart of the programmable micro controller 14. Please refer to FIGS. 2 and 4, a method of a phase angle process is described as follows.

Step S402: the phase angle detect unit 14*b* is prepared to acquire a phase angle.

Step S404: the control logic 14*e* determines whether the phase angle detect unit 14*b* is synchronous with the trigger signal of the bleeder; if yes, go to step S406; if not, go back to step S404.

Step S406: the phase angle detect unit 14*b* acquires the phase angle ag.

Step S408: the control logic 14*e* determines whether the current phase angle ag is a new phase angle; if yes, go to step S410; if not, go to step S404.

Step S410: the phase angle filter 14*c* filters the new phase angle and transmits the new phase angle to the control logic 14*e*.

Step S412: the control logic 14*e* determines whether the received phase angle is changed; if yes, go to step S414; if not, go to step S404.

Step S414: the control logic 14*e* transmits the phase angle related information to the dimming curve translator 14*f* to perform phase angle/brightness conversion to thereby provide a calculation result to the PWM unit 14*g*. In one embodiment, the control logic 14*e* transmits the new phase angle to the dimming curve translator 14*f* for conversion. In another embodiment, the control logic 14*e* transmits the variation amount of the phase angle to the dimming curve translator 14*f* for conversion.

Step S416: the PWM unit 14*g* generates a PWM signal corresponding to the calculation result.

It should be noted since frequency modulation control is used to control the bleeder 12, the phase dimmer 10 cannot operate in a steady state. If the phase angle is detected in real-time, the programmable micro controller 14 may obtain too many error phase angles. Therefore, the embodiment sets the phase angle detect unit 14*b* and the bleeder 12 operate synchronously to perform detecting operation. The programmable micro controller 14 turns on the phase angle detect unit 14*b* as the bleeder 12 works. Thus, the error rate of phase angle detection can be effectively decreased.

According to embodiments of the invention, the problems in the prior art can be solved. The embodiments include at least one of the following characteristics:

a. an adjustable linear load is used to simplify circuit design to decrease system cost;

b. the low efficiency and high power consumption for a conventional linear load are improved;

c. the programmable micro controller is designed by a micro controller framework and the programmable micro controller includes techniques of programmable system parameters, frequency modulation control, synchronous sampling, digital filter framework, dimming curve translator, PWM output and so forth. These techniques can let the embodiments of dimmer circuit be compatible with different TRIAC dimmers;

d. the operating method of the bleeder uses a frequency modulation control technique to decrease power consumption;

e. the phase detect circuit uses a sampling technique being synchronous with the bleeder when the phase angle of the phase dimmer is to be detected;

f. the phase angle filter is provided to filter noises to effectively acquire the phase angle wd of the phase dimmer as a dimming parameter;

g. the dimming curve translator can use the angle of the acquired phase angle wd to accompany with the output of the PWM signal by a certain ratio to implement a different dimming ratio;

h. the design of the PWM circuit can effectively and easily adjust the brightness of the LED device.

Although the present invention has been fully described by the above embodiments, the embodiments should not constitute the limitation of the scope of the invention. Various modifications or changes can be made by those who are skilled in the art without deviating from the spirit of the invention. Any embodiment or claim of the present invention does not need to reach all the disclosed objects, advantages, and uniqueness of the invention. Besides, the abstract and the title are only used for assisting the search of the patent documentation and should not be construed as any limitation on the implementation range of the invention.

What is claimed is:

1. A dimmer circuit, comprising:

a bleeder as a dummy load;

a phase dimmer for generating a signal corresponding to an adjustment of the phase dimmer by a user;

a phase detect circuit for detecting a phase angle of the signal;

a pulse width modulation (PWM) circuit for generating a PWM signal to drive a light emitting diode (LED) device; and a programmable micro controller, coupled to the phase detect circuit, wherein the programmable micro controller receives the signal and the phase angle to determine pulse width of the PWM signal according to the phase angle and the programmable micro controller generates a control signal to turn on/off the bleeder according to the phase angle.

2. The circuit according to claim 1, wherein after the programmable micro controller receives the phase angle, the programmable micro controller generates a control signal to turn off the bleeder, and if the phase angle of the signal is constant, the pulse width of the PWM signal remains the same.

3. The circuit according to claim 2, wherein the constant current circuit receives the PWM signal to generate a constant current to maintain the brightness of the LED device.

4. The circuit according to claim 1, wherein if the phase angle is changed, the programmable micro controller generates a control signal to turn on the bleeder to consume the load, and the programmable micro controller receives the phase angle.

5. The circuit according to claim 4, wherein after the programmable micro controller receives the phase angle, the programmable micro controller generates a control signal to turn off the bleeder, and the programmable micro controller adjusts the pulse width of the PWM signal according to the variation of the phase angle of the signal.

6. The circuit according to claim 4, wherein the constant current circuit adjusts its output current according to the adjusted PWM signal so as to change the brightness of the LED device.

7. The circuit according to claim 1, wherein the programmable micro controller comprises:

a phase angle filter, for filtering noises of the phase angle to generate a filtered signal; and a dimming curve translator, for receiving information related to the phase angle and converting the information to generate the pulse width corresponding to the information of the phase angle according to a dimming curve.

8. The circuit according to claim 1, wherein the programmable micro controller comprises:

a phase angle detect circuit, for detecting a phase angle of the signal;

a phase angle filter, for filtering noises of the phase angle;

a driver, for generating a driving signal according to a command to control the bleeder;

a timer, for generating a clock synchronous with the driver and the phase angle detect circuit;

a dimming curve translator, for providing a dimming curve;

a pulse width modulation circuit, for generating the PWM signal to control brightness of the LED device; and a control logic, for operating in coordination with the clock of the timer, receiving the phase angle, and determining how to generate a command to control the driver and how to control the pulse width modulation circuit to generate the PWM signal, according to the phase angle.

9. The circuit according to claim 1, wherein the phase dimmer is a triode for alternating current (TRIAC).

10. The circuit according to claim 1, wherein the operation and control method of the programmable micro controller can be modified by software, firmware or hardware.

11. The circuit according to claim 1, wherein the driver and the phase angle detect circuit are synchronous to each other.

12. A programmable micro controller, comprising:

a phase angle detect circuit, for detecting a phase angle of a signal provided by a phase detect circuit;

a phase angle filter for filtering noises of the phase angle;

a driver for generating a driving signal according to a command to control a bleeder;

a timer for generating a clock synchronous with the driver and the phase angle detect circuit;

a dimming curve translator for providing a dimming curve;

a pulse width modulation circuit, for generating a PWM signal to control brightness of the LED device; and a control logic for operating in coordination with the clock of the timer, receiving the phase angle, and determining the command to control the driver and the pulse width modulation circuit to generate the pulse width modulation signal, according to the phase angle.

13. A frequency modulation method for controlling a bleeder:

providing a tick timer and using a phase angle signal from a phase detect circuit to determine whether or not to increase or decrease tick timer and to compare if overflow occurs;

correlating the phase angle to a conversion curve and performing calculation to generate a corresponding pulse width modulation duty cycle to control brightness of a light emitting diode device; and determining whether a current phase angle is larger than a previous phase angle or not, decreasing the tick timer when the current phase angle is larger than the previous phase angle, and increasing the tick timer when the current phase angle is smaller than the previous phase angle;

wherein the bleeder is triggered when overflow occurs.

14. A method for a programmable micro controller to detect a phase angle, the method comprising:

determining whether an operating clock of phase angle detection is synchronous with a trigger signal of a bleeder or not and acquiring the phase angle when it is synchronous;

determining whether a current phase angle is a new phase angle or not and filtering the new phase angle if the current phase angle is a phase angle; and determining whether the received phase angle is changed or not; if the received phase angle is changed, performs phase angle/brightness conversion according to information related to the changed phase angle and provides the result to generate a corresponding PWM signal to control brightness of a light emitting diode device.

15. The method according to claim 14, wherein the information related to the changed phase angle is the value of the new phase angle or the variation amount between a prior phase angle and the new phase angle.

* * * * *